United States Patent [19]

Lefranc

[11] Patent Number: 4,848,966

[45] Date of Patent: Jul. 18, 1989

[54] ARRANGEMENT IN A PRODUCTION PLATFORM

[75] Inventor: Marc Lefranc, Lier, Norway

[73] Assignee: Aker Engineering A/S, Oslo, Norway

[21] Appl. No.: 180,522

[22] Filed: Apr. 12, 1988

[30] Foreign Application Priority Data

Apr. 23, 1987 [NO] Norway ..... 871699

[51] Int. Cl.[4] ..... E02B 17/00

[52] U.S. Cl. ..... 405/201; 175/9; 405/195

[58] Field of Search ..... 405/195, 201, 203, 224; 175/5, 9

[56] References Cited

U.S. PATENT DOCUMENTS 4,103,503 8/1978 Smith ..... 405/201 X 4,161,376 7/1979 Armstrong ..... 405/201 X

*Primary Examiner*—David H. Corbin

*Attorney, Agent, or Firm*—Hedman, Gibson, Costigan & Hoare

[57] ABSTRACT

A production platform for offshore exploitation of hydrocarbons comprises a truss tower (1) which rests on the sea floor (2) and supports a deck structure (3) provided with a drilling module (5). In order to obtain optimum mutual distance between production pipes (10) at the deck level, the skid beams (6) of the drilling module are arranged parallel to a diagonal (9) in the cross-section of the truss tower. Weight savings in the truss tower (1) may be obtained by arranging the deck structure (3) with its sides parallel to the diagonals (9) of the truss tower (1).

13 Claims, 4 Drawing Sheets

ARRANGEMENT IN A PRODUCTION PLATFORM

FIELD OF THE INVENTION

The present invention relates to an arrangement in a production platform for the offshore exploitation of hydrocarbons, comprising a supporting structure in the form of a truss tower resting on the sea floor and carrying a deck structure above the water surface, said truss tower having a quadrangular cross-sectional form and being provided with orthogonally intersecting diagonals, a plurality of production pipes leading from the deck structure to the sea floor through the inner space of the truss tower, and a drilling module arranged movable along parallel skid rails on the deck structure.

BACKGROUND OF THE INVENTION

In previously known platforms of this type the deck structure normally has had a generally rectangular base, the sides of the base being mutually parallel to the edges of the cross-section of the truss tower. The skid rails of the drilling module are also parallel to two of the base sides of the deck structure.

The location of the production pipes and other pipes which must be run from the deck and down into the sea floor, and the mutual distance between these, depend to a large extent on the available space present between the structural elements in the deck proper and between the elements of the truss tower. Normally it is required that these pipes run straight between the deck and the sea floor. In order to obtain room for the desired number of productions pipes, one has had to make the width of the truss structure so large that at least two of its sides at the top have coincided with two of the sides of the deck. This is i.a. due to the necessity of avoiding the internal diagonals of the truss structure, resulting in a wider spreading of the production pipes than their space requirement should indicate. This in turn affects the size and weigh of the total production platform.

It is an object of the present invention to provide a production platform of the type mentioned by way of introduction, which may be built at less cost for a given number of production pipes.

SUMMARY OF THE INVENTION

This is obtained according to the invention by said skid rails being arranged parallel to a diagonal direction in the cross-section of the truss tower.

Surprisingly it has been found that by arranging the skid rails of the drilling module in this way, the production pipes and other necessary piping may be arranged with approximately optimal mutual distance without interfering with the diagonal structural elements of the truss tower. Thus, the outer dimensions of the truss tower may be made smaller, resulting in the truss tower being lighter and less costly to fabricate and, furthermore, its installation at sea becoming simpler. In addition, the environmental stresses on the truss tower will be reduced.

In accordance with an advantageous embodiment of the invention, where the deck structure has generally a quadrangular base, the sides of the deck structure are generally parallel to the internal diagonals of the truss tower. In this way a better support for the deck structure is obtained so that the deck structure may be made larger for a given size of the truss structure.

In accordance with a second advantageous embodiment of the invention, at least two of the corners of the truss tower lie on sides of the deck structure. The good support of the deck structure obtained in this way makes it possible to build the deck structure lighter.

In accordance with the invention it is also suggested to make the truss structure with a rhombic cross-section. This embodiment gives particularly good support of a deck structure with a rectangular base. The support can be quite optimum if the corners of the truss tower all lie on or near the sides of the deck structure.

With such diagonal support of the deck structure, this will be subjected to torsion requiring special measures, but it has turned out to be relatively simple to counteract this torsion by arranging inclined struts starting from the points being supported by the corners of the truss tower.

BRIEF DESCRIPTION OF THE DRAWINGS

For better understanding of the invention, it will be described more closely with reference to the exemplifying embodiments shown in the appended drawings, it being understood that these do not limit the scope of the invention.

Figure 1:
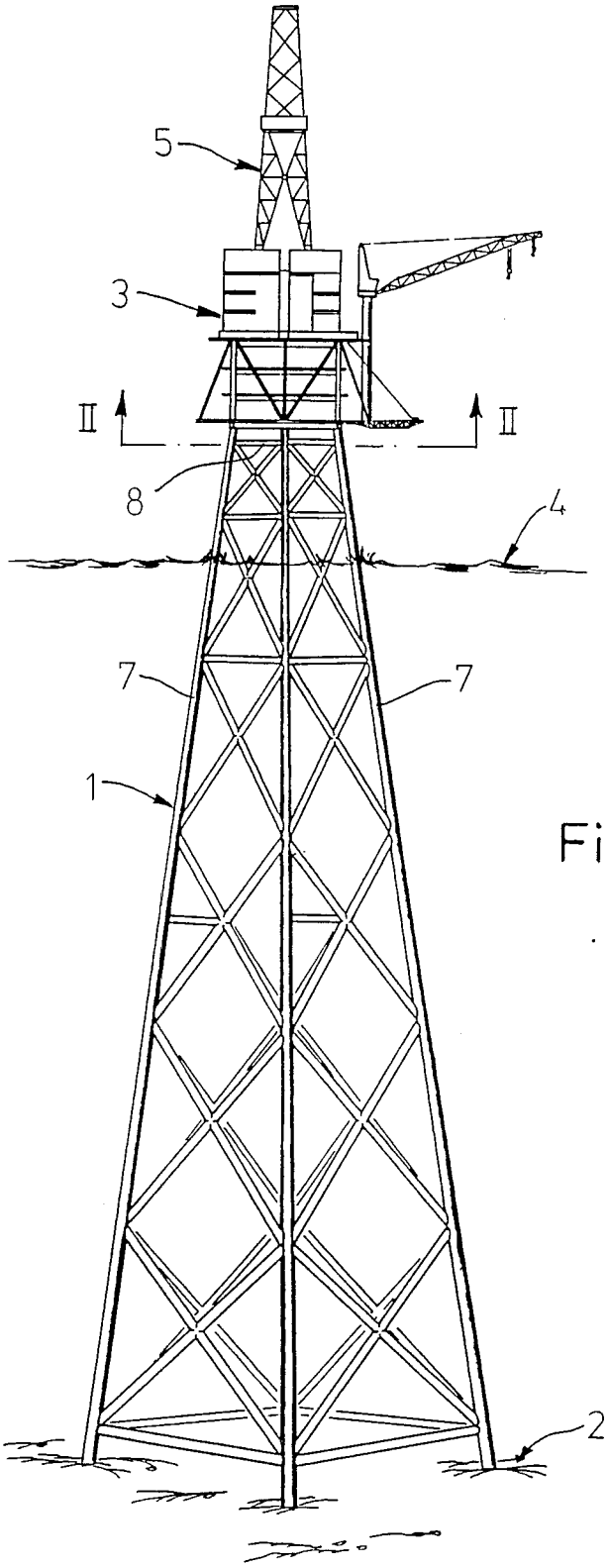
FIG. 1 shows a side view of a production platform according to the invention.

The production platform shown in FIG. 1 comprises a supporting structure in the form of a truss tower 1, which is supported on the sea floor 2 and carries a deck structure 3 above the water surface 4. A drilling module 5 is arranged on the deck structure, the drilling module being movable along parallel skid rails (not shown).

Figure 2:
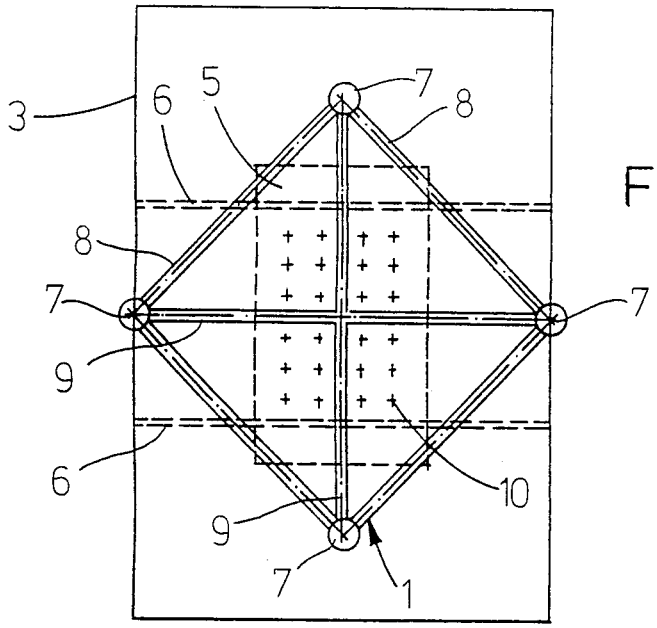
FIG. 2 is a cross-sectional view taken along line II—II in FIG. 1.

FIG. 2 shows the deck structure 3 and the uppermost part of the truss tower 1 seen from below. The drilling module 5 is shown in broken lines and the same is true for its skid rails 6. The corner legs of the truss tower are denoted 7 and these are mutually connected by means of horizontal stays 8. Between the corner legs 7 diagonal structural elements 9 extend and cross each other orthogonally at the center of the truss tower.

The location of the production pipes of the platform structure are indicated by 10. It will be seen that these form a pattern having generally equal mutual distance even though the internal diagonals 9 of the truss tower cut through their middle.

Figure 3:
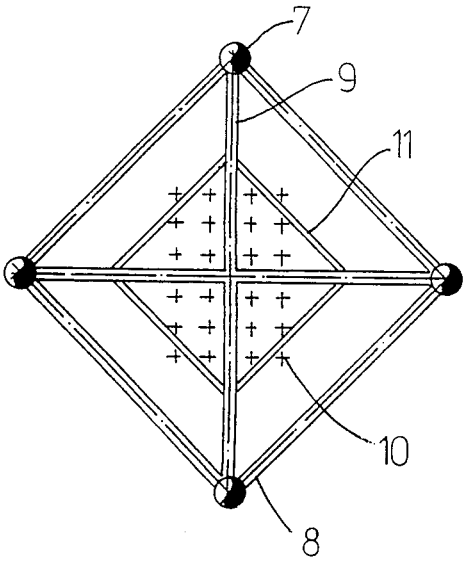
FIG. 3 is a cross-sectional view similar to FIG. 2 of an alternative embodiment of the truss tower of the production platform and with the deck structure removed for the sake of clarity.

FIG. 3 shows that the pattern of the production pipes may be made just as dense even though further internal stays 11 are arranged between the diagonals 9.

Figure 4:
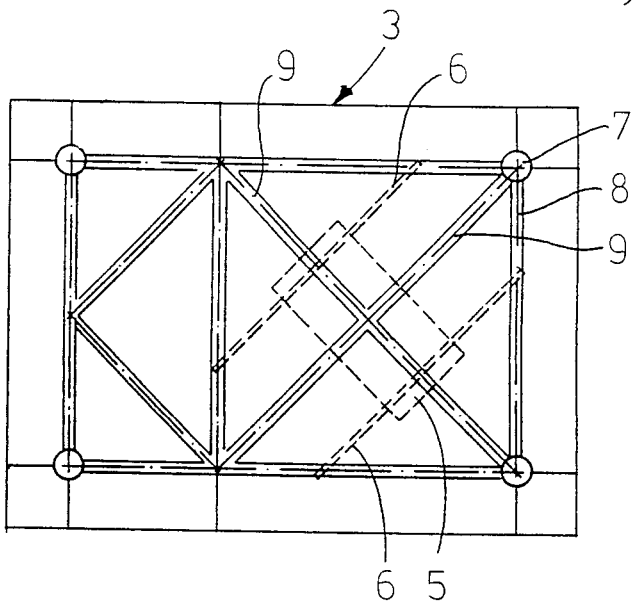
FIG. 4 is a cross-sectional view similar to FIG. 2, but with a truss tower having rectangular cross-section and parallel orientation of the deck.

In the embodiment illustrated in FIG. 4 the deck structure 3 has a rectangular base, as is the case also for FIG. 2. In FIG. 4, however, also the cross-section of the truss tower 1 is rectangular, the long and short sides of the cross-section being parallel to the long and short sides, respectively, of the base of the deck structure. In this respect this example is quite conventional. However, it will be seen that the rectangular cross-section of the truss tower is divided in a square and a rectangle, the square being provided with orthogonal diagonals 9. The rails or skid beams 6 of the drilling module 5 here are arranged parallel to one of these diagonals 9, so that also in this case the production pipes may be placed in the most optimum pattern.

Figure 5:
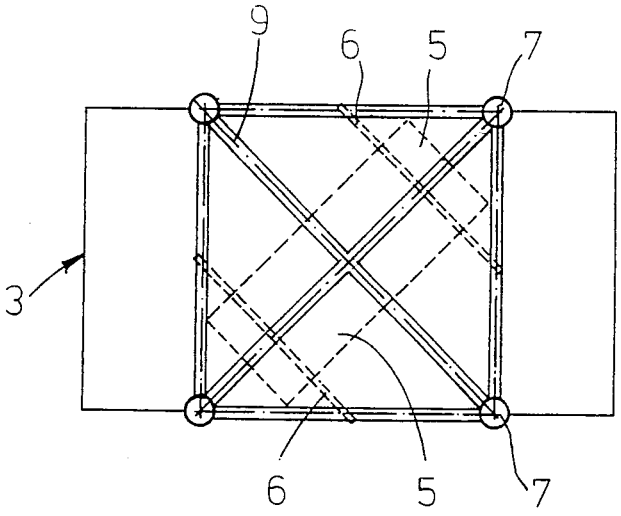
FIG. 5 is a cross-sectional view similar to FIG. 2, but where the deck is turned with respect to the diagonals of the truss tower.

In the embodiment in FIG. 5 the cross-section of the truss tower is square, while the base of the deck structure is rectangular, and in this case the corner legs 7 of the truss tower end at the long sides of the deck structure. Also in this case the skid rails 6 of the drilling module 5 are parallel to one of the internal diagonals 9 of the truss tower. This embodiment is advantageous where one does not need a particularly large deck structure 3, but where the dimensions of the truss tower is determined by the required number of wells or production pipes.

Figure 6:
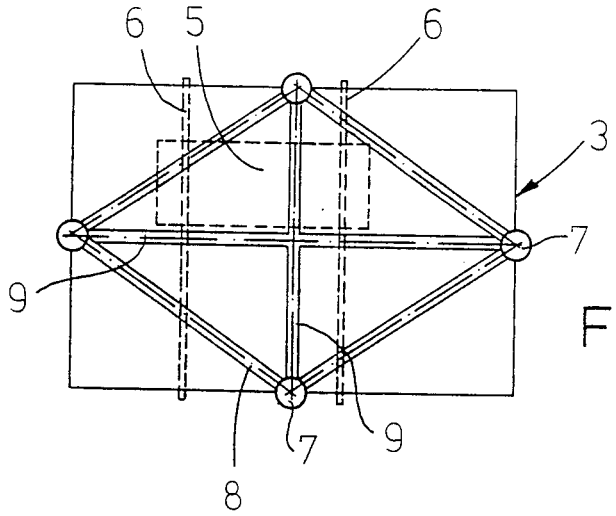
FIG. 6 is a cross-sectional view similar to FIG. 2, where the truss tower has rhombic cross-section.

FIG. 6 shows a truss tower having rhombic cross-section. In this case the corner legs 7 of the tower all end at the sides of the rectangular deck structure, thus providing very good support of the deck structure. This embodiment is particularly suitable for high and heavy deck structures. In addition, the truss tower may be built with higher rigidity and resistance against environmental influence from a given prevailing direction. It will be seen that the skid rails 6 of the drilling module are parallel to the short diagonal of the tower, but that they are unsymmetrically placed with respect to this diagonal. In certain cases this will provide the most optimum location of the production pipes.

Figure 7:
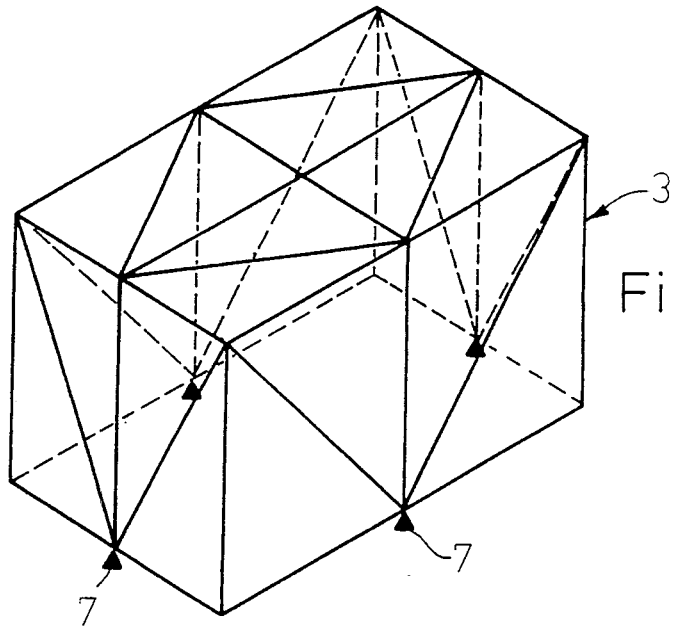
FIG. 7 shows schematically and isometrically the bracing system for a deck structure supported in accordance with the invention.

When the deck structure is arranged parallel to the truss tower, generally speaking only bending will occur in the cantilevered or projecting parts of the deck structure. However, if the deck structure is aligned with the diagonals of the truss tower, a somewhat unusual situation will occur involving torsional stresses requiring particular measures. However, it has turned out to be relatively simple to build the necessary torsional stiffness into the deck structure, and an example of how tension and compression struts may be arranged in the deck structure of FIG. 6 is schematically shown in FIG. 7.

It will be understood that the invention is not limited to the embodiments shown, but may be varied and modified within the scope of the appended claims. Thus, the base of the deck structure may have a different number of sides than the cross-section of the truss tower, a deck with six or eight sides may for instance be envisaged. The deck may for instance also have the approximate form of a T or H. Furthermore, it is possible to envisage a circular deck.

What is claimed is:

1. An Arrangement in an offshore production platform comprising:

(a) a deck positioned above the surface of the water and having at least one pair of spaced-apart rails thereon;

(b) drilling means mounted on the spaced apart rails and adapted to move along the rails between different locations on the deck;

(c) a truss tower mounted to the sea floor for supporting the deck, said truss tower comprising at least two pairs of opposed legs connected to the deck at one end and connected in at least one location along their length by two orthogonally intersecting support means, wherein the rails of the deck are parallel to one of the support means; and (d) production pipe means extending from the deck to the sea floor within the area bounded by the legs of the truss tower.

2. The arrangement of claim 1, where the deck comprises a quadrangular base and opposed sides extending from the base and wherein the sides of the deck are substantially parallel to the support means of the truss tower.

3. The arrangement of claim 1, wherein the truss tower has a quadrangular shaped cross-section.

4. The arrangement of claim 3, wherein the truss tower has a substantially rhombic shaped cross-section.

5. The arrangement of claims 3 or 4, wherein the ends of the legs of the truss tower connected to the deck lie on or near the sides of the deck.

6. The arrangement of claim 1, wherein the rails of the deck are not parallel to one of the support means of the truss tower.

7. The arrangement of claim 6, wherein the pair of support means are of unequal length, said rails being parallel to the shorter of the two support means.

8. The arrangement of claim 1, where the truss tower has a substantially rectangular cross-section, divided into a rectangular portion, and a square portion having said support means therein, wherein one of said support means is parallel to the rails on the deck.

9. The arrangement of claim 1, further comprising struts extending at an angle from the opposed legs of the truss tower to the deck.

10. The arrangement of claim 9, wherein the number of sides of the deck exceeds the number of legs of the truss tower.

11. The arrangement of claim 1 wherein the production pipe means comprises a plurality of pipes.

12. The arrangement of claim 1 wherein the platform is employed for the production of hydrocarbons.

13. The arrangement of claim 1 comprising two pairs of opposed legs.

* * * * *